US012359458B2

(12) United States Patent
Carbonaro

(10) Patent No.: US 12,359,458 B2
(45) Date of Patent: Jul. 15, 2025

(54) APPARATUS FOR UNIFYING STRUCTURAL CONTINUOUS LOAD PATHS AND REINFORCING A ROOFING STRUCTURAL SYSTEM UTILIZING SUPER HIGH TENSILE STRENGTH TAPE AND PLASTIC ATTACHMENT MECHANISMS

(71) Applicant: Peter Frank Carbonaro, Chicago, IL (US)

(72) Inventor: Peter Frank Carbonaro, Chicago, IL (US)

( * ) Notice: Subject to any disclaimer, the term of this patent is extended or adjusted under 35 U.S.C. 154(b) by 424 days.

(21) Appl. No.: 17/533,026

(22) Filed: Nov. 22, 2021

(65) Prior Publication Data

US 2022/0162873 A1 May 26, 2022

Related U.S. Application Data

(60) Provisional application No. 63/116,991, filed on Nov. 23, 2020.

(51) Int. Cl.

| | |
|---|---|
| ***E04H 9/14*** | (2006.01) |
| ***D07B 1/02*** | (2006.01) |
| ***D07B 1/22*** | (2006.01) |
| ***E04B 1/38*** | (2006.01) |
| ***E04B 1/41*** | (2006.01) |

(52) U.S. Cl.

CPC ..... *E04H 9/14* (2013.01); *D07B 1/025* (2013.01); *D07B 1/22* (2013.01); *E04B 1/388* (2023.08); *D07B 2205/205* (2013.01); *D07B 2501/2015* (2013.01); *E04B 2001/389* (2023.08)

(58) Field of Classification Search

CPC ..... E04H 9/14; E04B 1/388; E04B 2001/389; D07B 1/025; D07B 1/22; D07B 2501/2015; C09J 7/20; C09J 7/21

USPC ..... 442/189; 428/293.7, 295.4, 298.1

See application file for complete search history.

(56) References Cited

U.S. PATENT DOCUMENTS

| | | | |
|---|---|---|---|
| 1,657,441 | A | 1/1928 | Huovinen |
| 3,805,873 | A | 4/1974 | Bloomfield |
| 3,830,024 | A | 8/1974 | Warnke |
| 4,053,008 | A | 10/1977 | Baslow |
| 4,397,122 | A | 8/1983 | Cros |

(Continued)

FOREIGN PATENT DOCUMENTS

CN 108813786 A * 11/2018

OTHER PUBLICATIONS

Aramid Woven Tape ACP Composites and Aramid Wovwen Tape ACP Widths (Year: 2014).*

(Continued)

*Primary Examiner* — Jeremy R Pierce

(57) ABSTRACT

A new Super High Tensile Strength Tape (SHTST) which delivers super high performance in strength and low elongation which can be used in a roof reinforcing and attaching system to aid in securing the roofing members and supporting walls to the building's foundation, so as to supplement and unify the roofing assembly and wall sections in resistance to lift-off, failure and destruction in high-wind, seismic and other destructive events. Said SHTST can also be used in applications for automotive and vehicular, for packaging, for industrial uses, for military applications and for any other application where significant reinforcing and unifying resistance to destructive forces is desired.

1 Claim, 10 Drawing Sheets

(56) References Cited

U.S. PATENT DOCUMENTS

| | | | |
|---|---|---|---|
| 4,631,786 | A | 12/1986 | Curry |
| 4,757,854 | A | 7/1988 | Rippberger |
| 4,763,452 | A | 8/1988 | Harvey |
| 4,815,562 | A | 3/1989 | Denny et al. |
| 4,986,332 | A | 1/1991 | Lanuza |
| 5,009,540 | A | 4/1991 | Nolan |
| 5,046,545 | A | 9/1991 | Loomis et al. |
| 5,148,640 | A | 9/1992 | Reilly, Sr. |
| 5,214,891 | A | 6/1993 | Edlin |
| 5,303,520 | A | 4/1994 | Gozdziak |
| 5,311,712 | A | 5/1994 | Accousti |
| 5,333,425 | A | 8/1994 | Nickerson et al. |
| 5,355,640 | A | 10/1994 | Frye |
| 5,448,861 | A | 9/1995 | Lawson |
| 5,531,054 | A | 7/1996 | Ramirez |
| 5,537,786 | A | 7/1996 | Lozier |
| 5,570,545 | A | 11/1996 | Adams |
| 5,603,186 | A | 2/1997 | Zaffino |
| 5,870,861 | A | 2/1999 | Gnaedinger |
| 5,953,875 | A | 9/1999 | Harkins |
| 6,164,364 | A | 12/2000 | Morris |
| 6,176,050 | B1 | 1/2001 | Gower |
| 6,256,951 | B1 | 7/2001 | Findleton |
| 6,287,658 | B1 | 9/2001 | Cosentino et al. |
| 6,305,111 | B1 | 10/2001 | Opdahl |
| 6,324,797 | B1 | 12/2001 | Fago et al. |
| 6,325,085 | B1 | 12/2001 | Gower |
| 6,339,889 | B1 | 1/2002 | Griesemer |
| 6,412,540 | B2 | 7/2002 | Hendee |
| 6,598,651 | B2 | 7/2003 | Ehrenberger |
| 6,684,584 | B1 | 2/2004 | Goldwitz |
| 6,758,306 | B2 | 7/2004 | Walls et al. |
| 6,760,990 | B2 | 7/2004 | Lowndes |
| 6,843,027 | B2 | 1/2005 | Gaddie et al. |
| 6,886,299 | B2 | 5/2005 | Gower |
| 6,886,300 | B2 | 5/2005 | Hudoba et al. |
| 7,246,473 | B2 | 7/2007 | Lau et al. |
| 7,392,620 | B1 | 7/2008 | Watson, Jr. |
| 7,578,100 | B2 | 8/2009 | Sicurella |
| 7,650,923 | B2 | 1/2010 | Morris |
| 7,726,081 | B1 | 6/2010 | Bennardo et al. |
| 7,805,891 | B2 | 10/2010 | Lozier et al. |
| 7,900,408 | B2 | 3/2011 | Holland et al. |
| 7,963,313 | B1 | 6/2011 | Bennett et al. |
| 7,980,033 | B1 | 7/2011 | Fyfe |
| 8,215,072 | B2 | 7/2012 | Gorman |
| 8,215,073 | B2 | 7/2012 | Gorman et al. |
| 8,631,615 | B2 | 1/2014 | Carbonaro |
| 8,646,222 | B2 | 2/2014 | Carbonaro et al. |
| 8,910,436 | B2 | 12/2014 | Carbonaro |
| 8,943,761 | B2 | 2/2015 | Carbonaro et al. |
| 2004/0081815 | A1* | 4/2004 | Baudonnel ..... D03D 3/005 428/292.1 |
| 2004/0154242 | A1 | 8/2004 | Hudoba et al. |
| 2005/0211396 | A1 | 9/2005 | Doiron et al. |
| 2006/0207191 | A1 | 9/2006 | Sutton |
| 2007/0022672 | A1 | 2/2007 | Hasselbeck |
| 2007/0204533 | A1 | 9/2007 | Gower |
| 2007/0227083 | A1 | 10/2007 | Skobba |
| 2007/0234658 | A1 | 10/2007 | Rawdon et al. |
| 2007/0281562 | A1 | 12/2007 | Kohlman et al. |
| 2008/0110583 | A1 | 5/2008 | Lallemand |
| 2008/0148655 | A1 | 6/2008 | Posey |
| 2008/0213526 | A1 | 9/2008 | Serra et al. |
| 2008/0313979 | A1 | 12/2008 | Holland et al. |
| 2008/0313980 | A1 | 12/2008 | Holland et al. |
| 2009/0004430 | A1 | 1/2009 | Cummins et al. |
| 2009/0019797 | A1 | 1/2009 | Gunn |
| 2009/0042471 | A1 | 2/2009 | Cashin et al. |
| 2009/0049765 | A1 | 2/2009 | Grant |
| 2009/0307988 | A1 | 12/2009 | Hamlin, III |
| 2010/0043315 | A1 | 2/2010 | Fannon et al. |
| 2010/0107528 | A1 | 5/2010 | Toledo |
| 2010/0126091 | A1 | 5/2010 | Meyer |
| 2010/0236158 | A1 | 9/2010 | Carbonaro |
| 2011/0036020 | A1 | 2/2011 | Curry, III |
| 2011/0072732 | A1 | 3/2011 | Schilling |
| 2012/0171916 | A1 | 7/2012 | Serra et al. |
| 2012/0273641 | A1 | 11/2012 | Gorman et al. |
| 2014/0186600 | A1* | 7/2014 | Dyksterhouse ..... B32B 5/024 428/298.1 |
| 2023/0106797 | A1 | 4/2023 | Frederiksen et al. |

OTHER PUBLICATIONS

"New Kevlar® Advanced Performance Fibers from DuPont," Oct. 20, 2009, available at https://www.wire-tradefair.com/en/Media_News/News/Archive_Industry-News/New_Kevlar%C2%AE_Advanced_Performance_Fibers_from_DuPont (Year: 2009).*

ITW Buildex 2021-2023 Product Catalog, Trubolt Wedge Anchors, Heavy Duty Concrete Anchors, pp. 56-59.

Stanley Bostitch Sheather Plus TM Nails, brochure pp. 1-2.

ITW Buildex 2021-2023 Product Catalog, Maxi-Set Tapcon Masonry System, Driving Concrete Connections, pp. 50-65.

Simpson Strong-Tie Company Inc., Wood Construction Connectors 2021-2023 Catalog, www.strongtie.com.

* cited by examiner

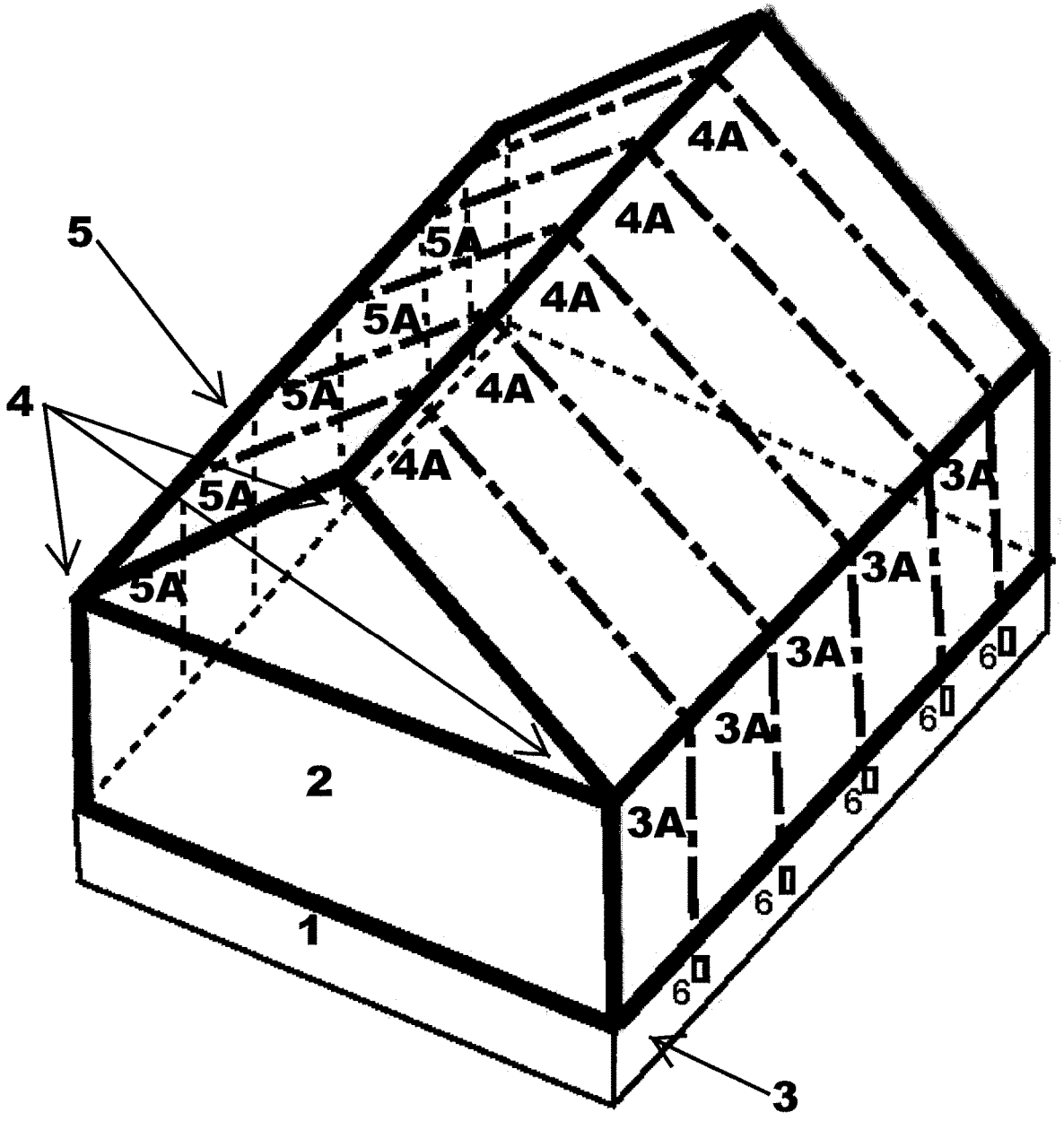
Figure #1

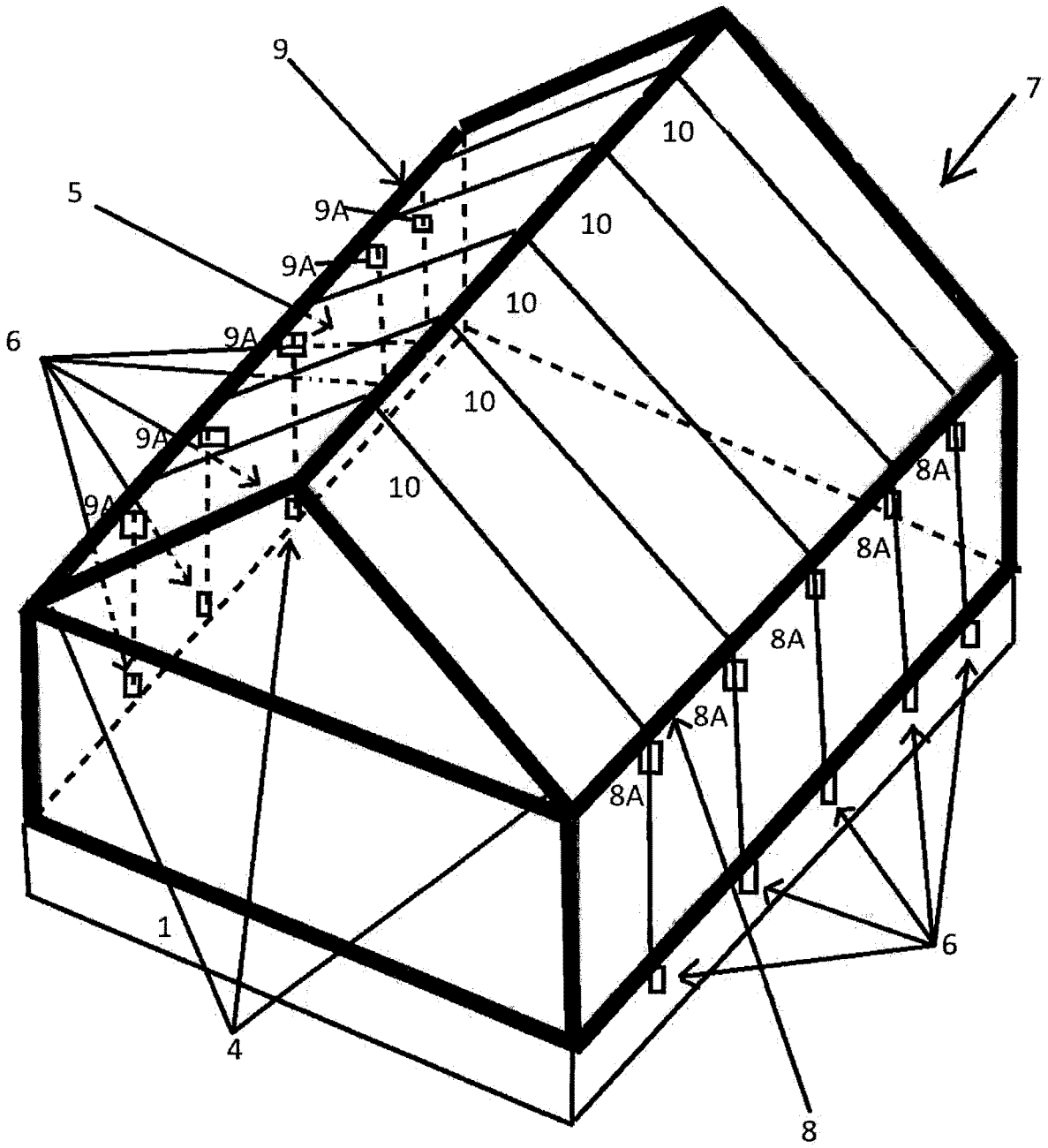
Figure #2

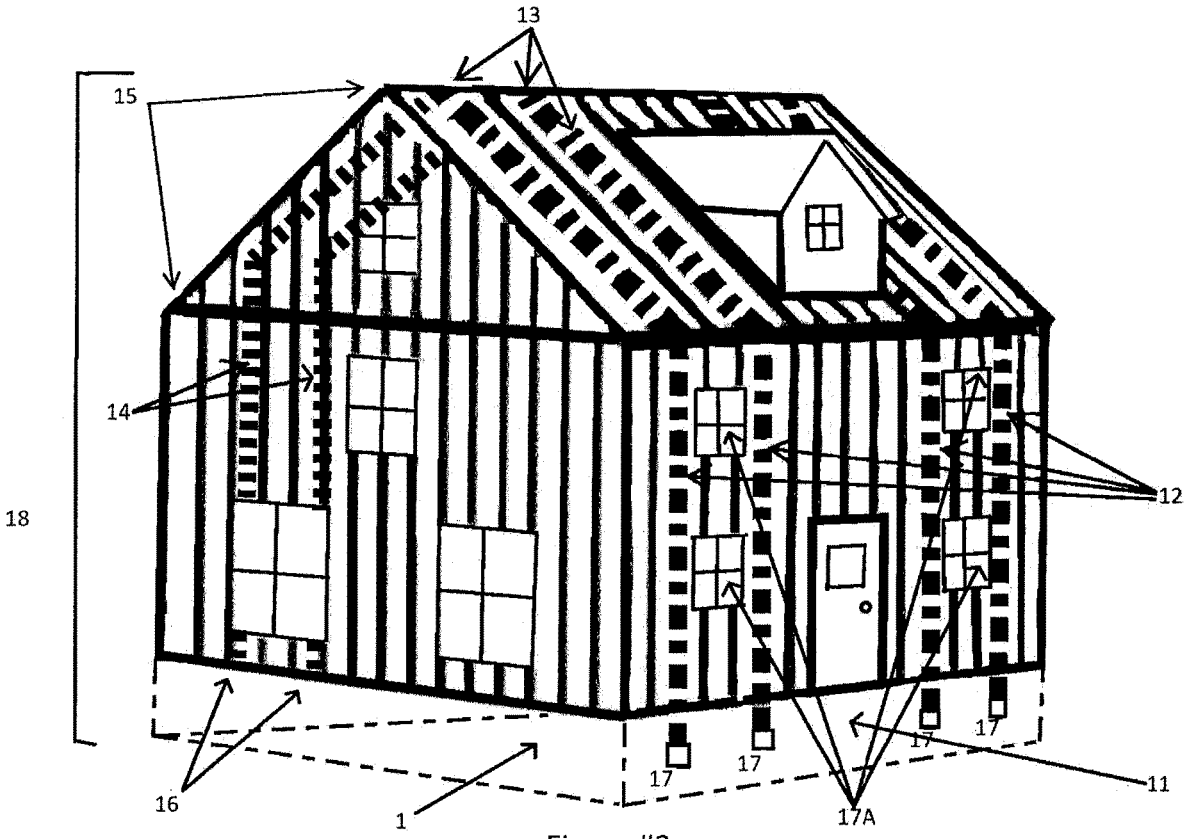
Figure #3

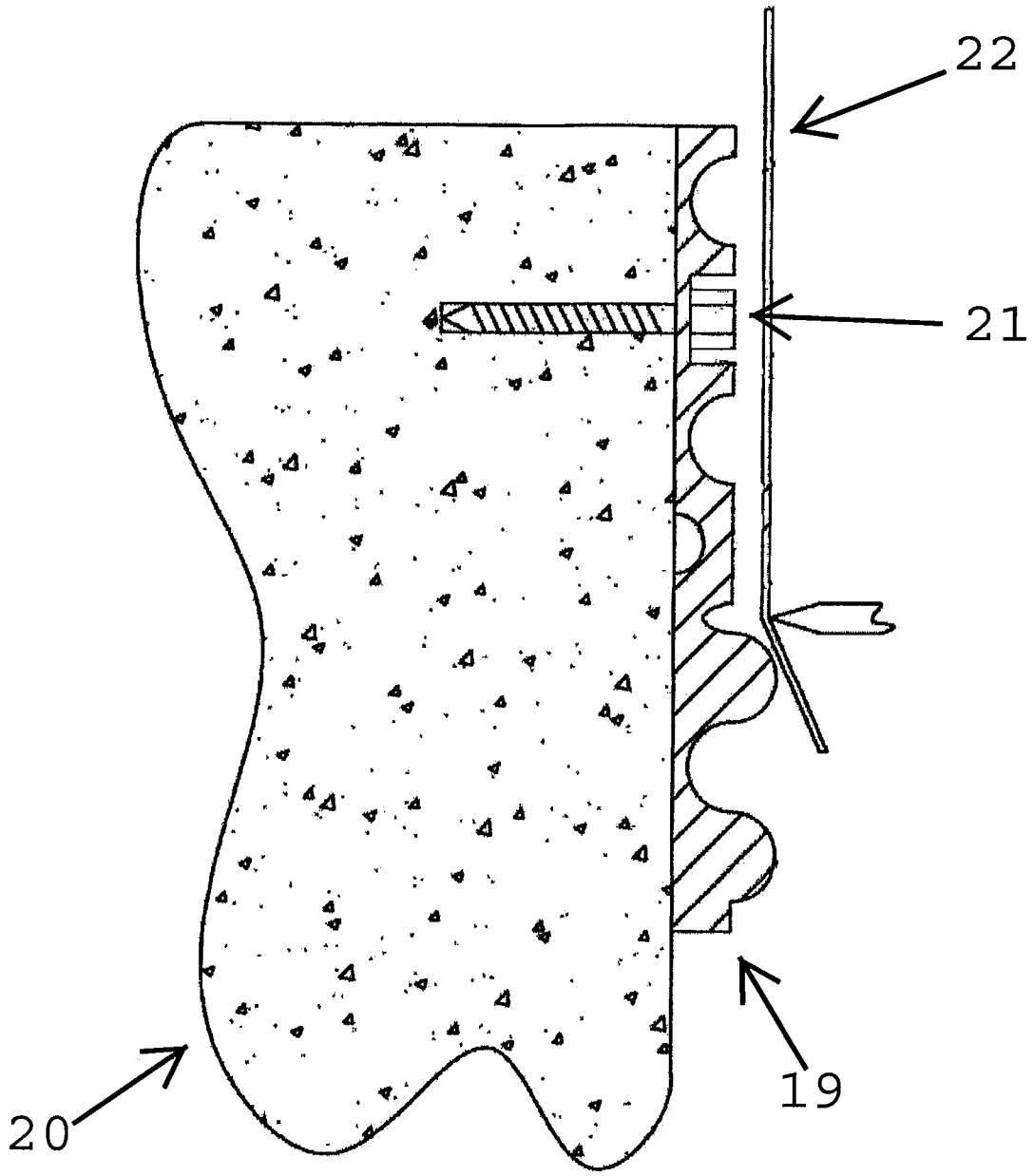
Figure #4

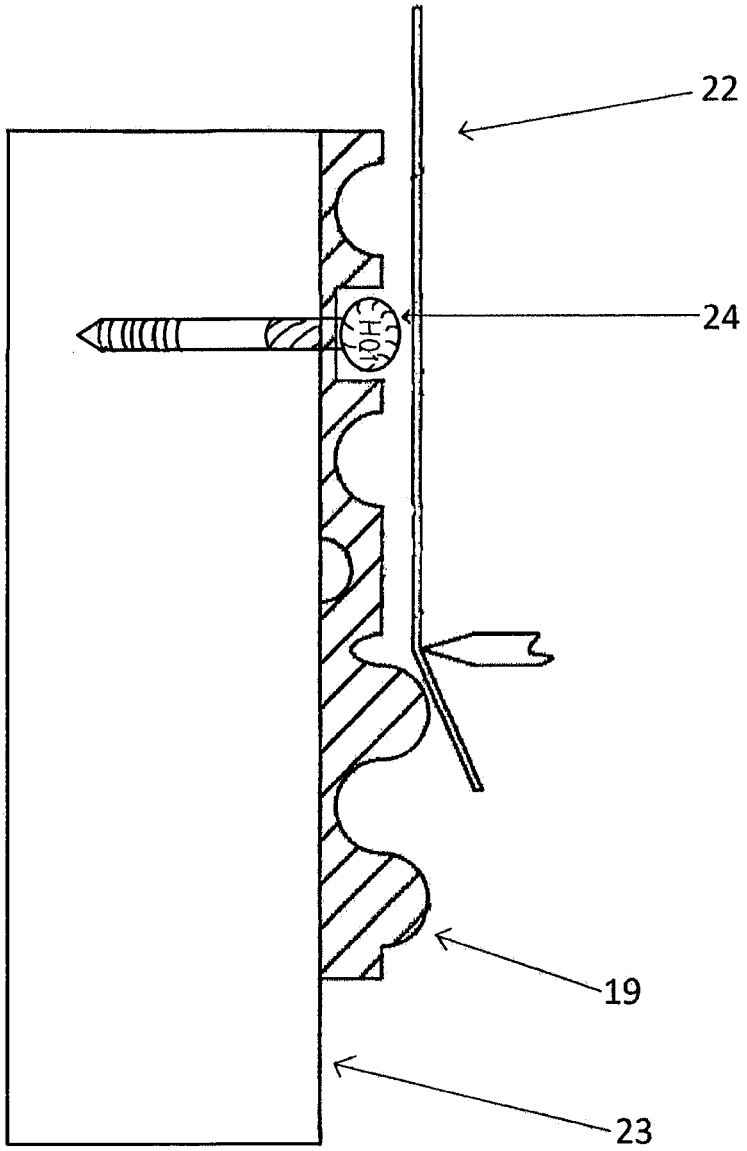
Figure #4a

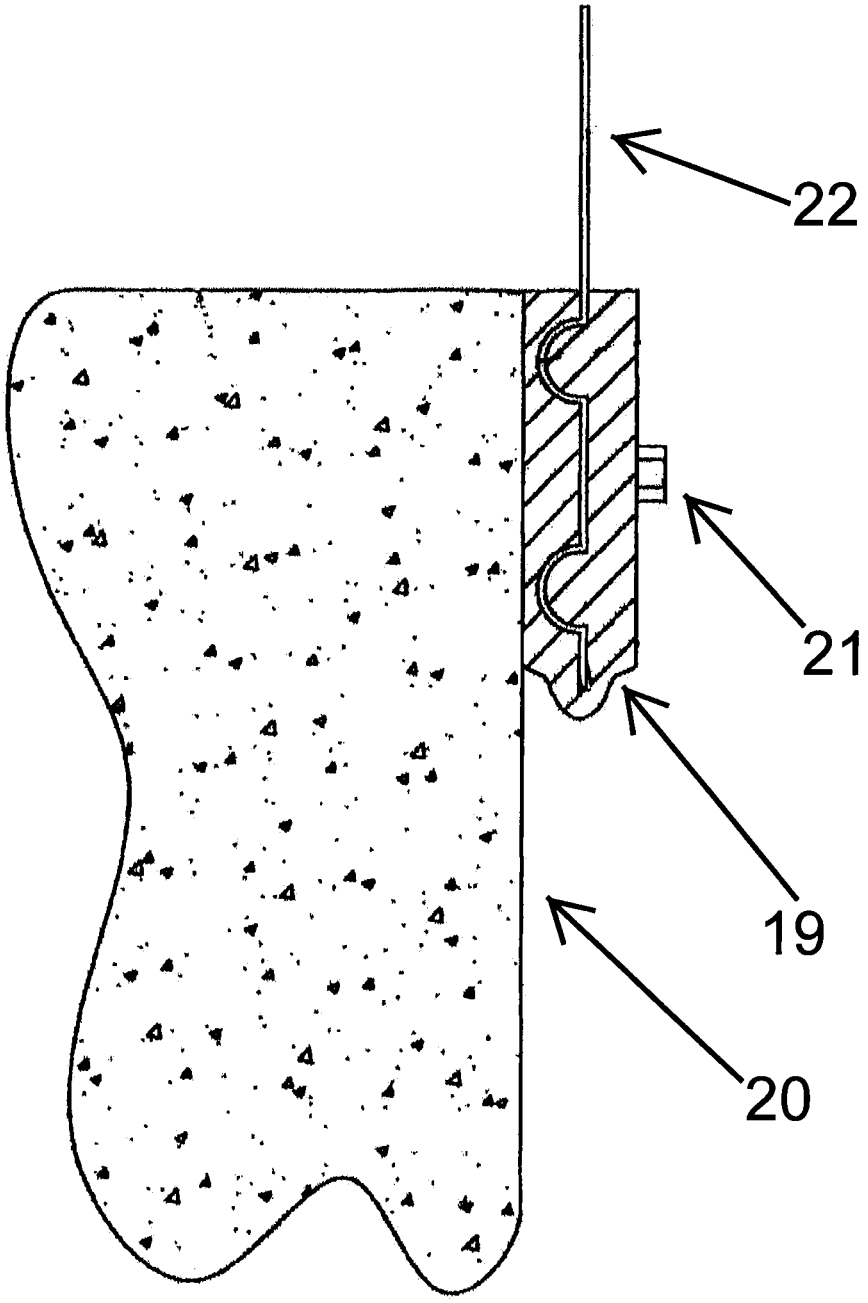
Figure #5

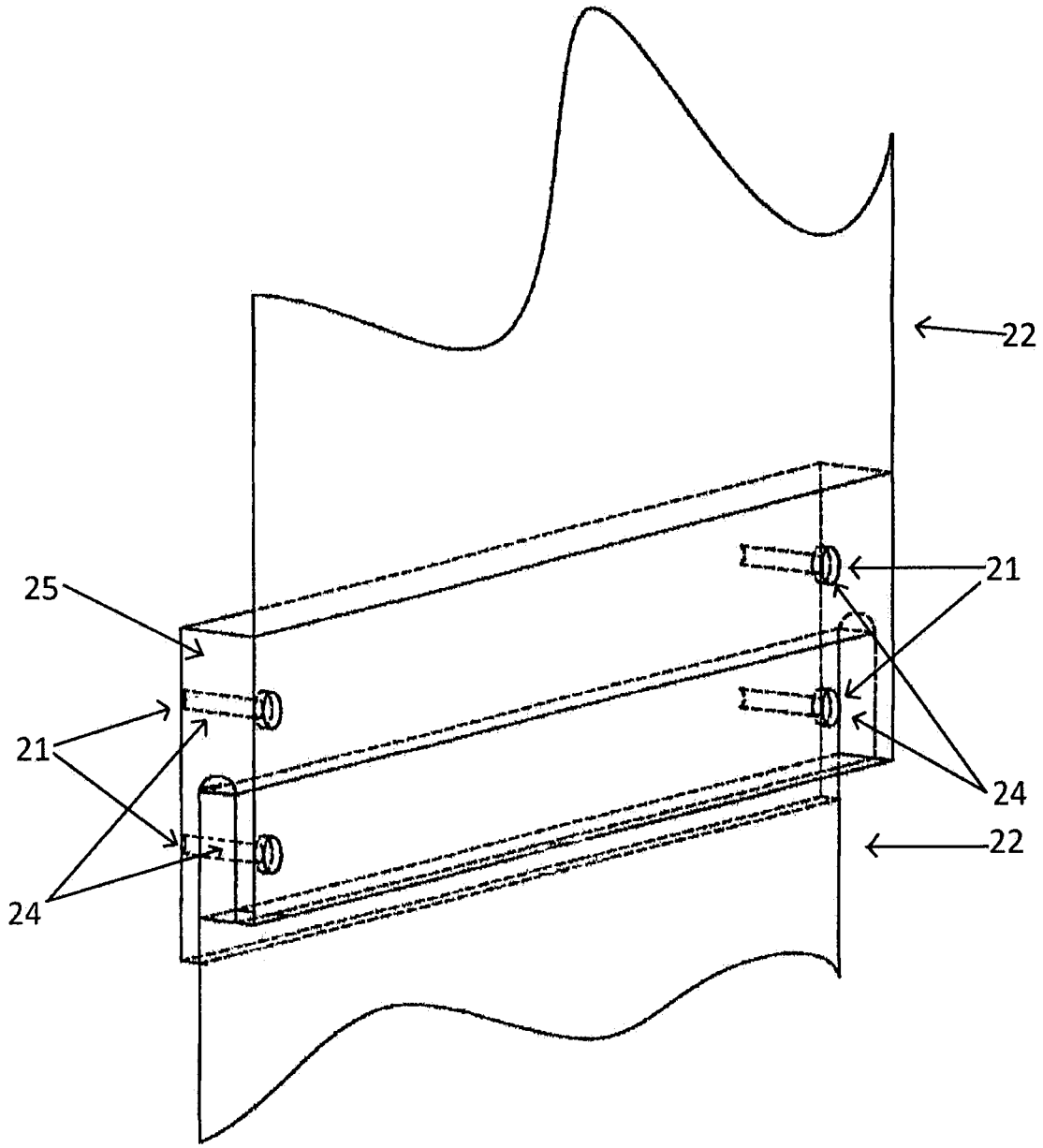
Figure #6

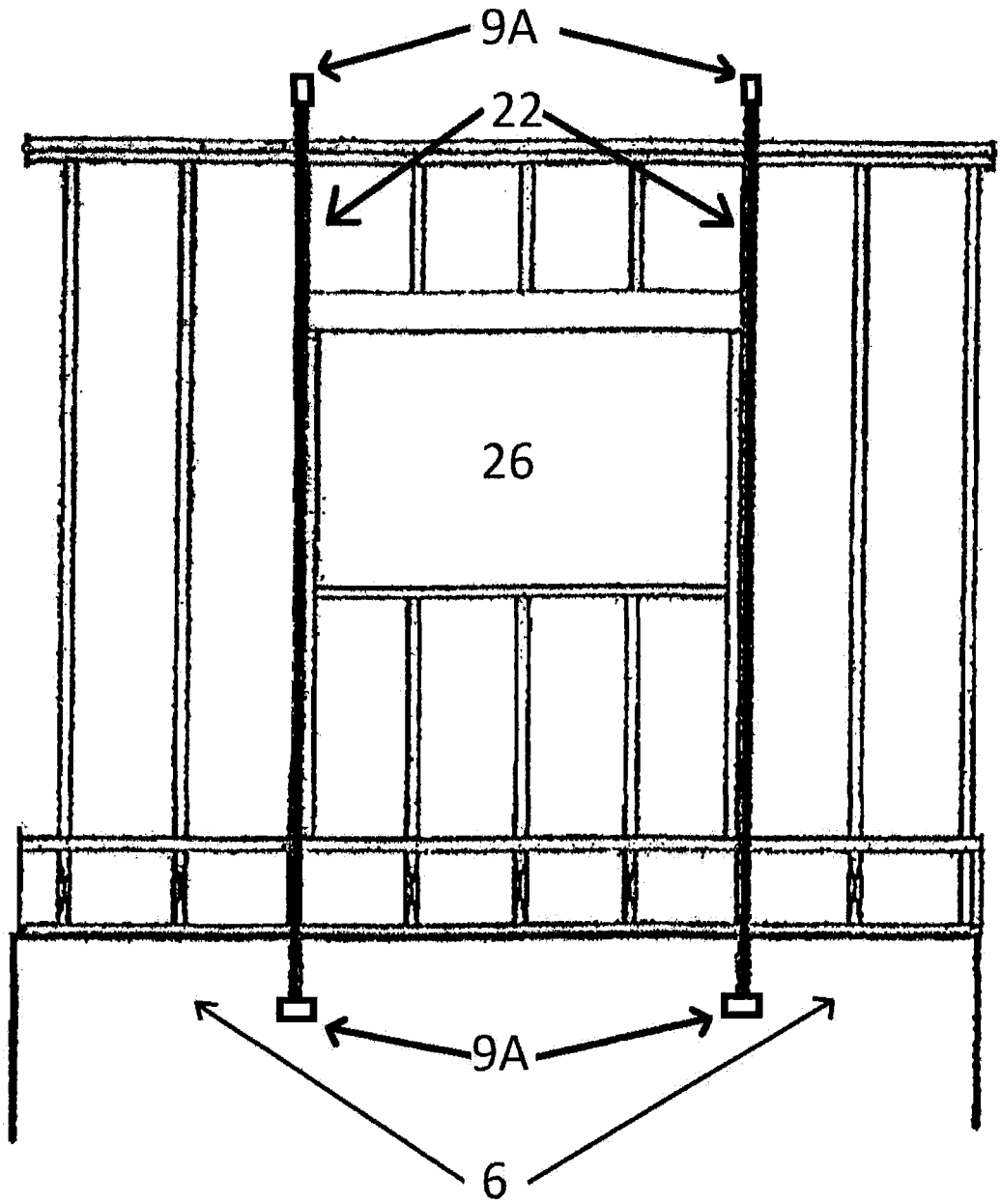
Figure #7

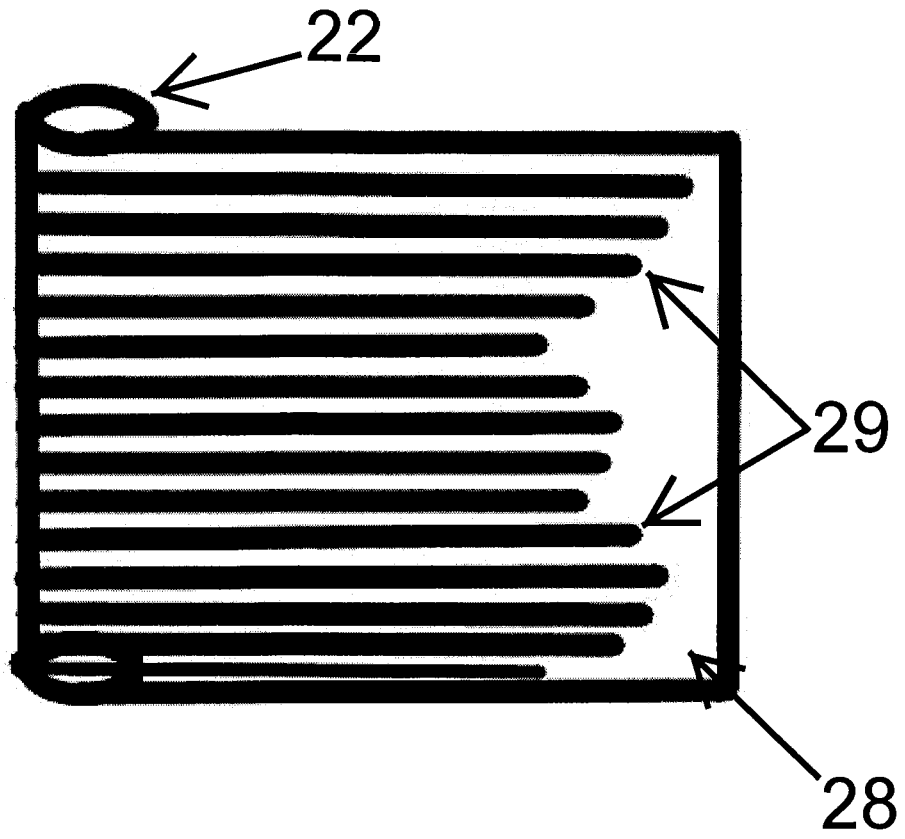
Figure #8

APPARATUS FOR UNIFYING STRUCTURAL CONTINUOUS LOAD PATHS AND REINFORCING A ROOFING STRUCTURAL SYSTEM UTILIZING SUPER HIGH TENSILE STRENGTH TAPE AND PLASTIC ATTACHMENT MECHANISMS

CROSS-REFERENCE TO RELATED APPLICATION

This application is based on and claims priority to U.S. Provisional Application 63/116,991 filed on Nov. 23, 2020, the entire content of which is expressly incorporated herein.

BACKGROUND OF THE INVENTION

This invention relates to a roof reinforcing and attaching system to aid in securing the roofing members and supporting walls to the buildings foundation, so as to supplement and unify the roofing assembly and wall sections in their resistance to lift-off, failure and destruction in high-wind, seismic and other destructive events. It is comprised of a Super High Tensile Strength Tape or Ribbon Strip (SHTST). Said SHTST is affixed to the roof structure, wall sections and foundation utilizing high strength plastic attachment mechanisms. This invention relates to unifying and enforcing a roofing structural system and affixing it to the underlying building structure. This system provides and accords continuity of opposite Continuous Load Paths (CLP), so as to help reinforce the overall structure's resistance to high wind, seismic and other destructive events. The utilization of the attachment mechanisms facilitates the overall objective of connecting the opposite CLP to provide a uni-structure approach. This is analogous to uni-body construction in the auto industry. This system utilizes SHTST together with plastic attachment mechanisms to provide the continuity from one CLP to the structure's opposite CLP, thus providing a unified load path around the structure to resist uplifting forces and lateral forces to enhance the structure's integrity and its resistance to these disruptive and destructive forces.

The SHTST is comprised of aramids, specifically including Kevlar® threads in the machine direction of the SHTST enabling the Super Strong Kevlar® threads and fibers to provide resistance to these uplifting and lateral forces to maintain the integrity of the structure. This SHTST can be delivered as a stand alone scrim via a underlying tape (with or without adhesive) or ribbon strip to facilitate easy installation. In addition the scrim can be married to exterior sheathing, including Plywood, OSB, foam board, cement board, or other sheathing mediums. This can be married in factories or job sites, and includes application in modular homes and pre-assembled wall and roof sections.

The underlying concept is to provide a medium, scrim, tape or ribbon strip, which will connect load paths on one wall of a structure, over the roof structure, to the opposite wall's corresponding load path, providing continuity of opposite load paths. These concepts shall be applied in the field. In addition to the applications of uni-structure or uni-body concepts set forth above, these concepts shall also be applied to structures made or assembled in factories. Also, these concepts shall be applied and modified with additional attaching mechanisms in modular construction.

SUMMARY OF THE INVENTION

This invention relates to an Apparatus of unifying and reinforcing a roofing structural system utilizing Super High Tensile Strength Tapes or Ribbon Strips, and Plastic Attachment Mechanisms to the means of or for supporting said roof structure, comprising a securing mechanism or mechanisms, unifying and connecting opposite Continuous Load Paths so as to result in a unified path extending from one foundation of the structure to the opposite foundation, thus providing a unified path of resistance to any uplifting or lateral forces or other potentially destructive forces during a high wind, seismic or other destructive event.

In one instance the SHTST can be used in one continuous strip to extend from the top of one foundation, up the wall and over the roof structure and then down the opposite wall to the top of the opposite foundation wall where it is attached the attachment mechanisms which are listed in this Application for Patent. In another instance the SHTST can be used segmentally to provide a load path from the top of a foundation to the side of that wall's top plates, from the wall's top plates over the roof structure to the opposite wall's top plate area and then down the opposite wall to the top of the opposite foundation wall. Each of these segments are affixed to the structure utilizing the listed Attachment Mechanisms. Alternatively, in lieu of the Attachment Mechanisms, these segments may be joined to each other by overlapping the SHTST which has adhesive and has been designated as "Good to Overlap". This overlapping section shall comply with the directions on the "Good to Overlap" packaging.

The apparatus for unifying and reinforcing a roofing structural system which utilizes Super High Tensile Strength Tapes or Ribbon Strips, and Plastic Attachment Mechanisms provides for connecting the Load Paths to both of the means of supporting the roofing structure. This connection or continuity of Load Paths provides a better resistance to uplifting, lateral forces during a high wind, seismic or other destructive event. The elimination of metal clips, straps and connectors which are subject to rusting, corrosion and the resultant loss of strength therefrom, and replacing them with Aramids, and plastics results in a structure with a high degree of Resiliency and Sustainability.

BRIEF DESCRIPTION OF THE DRAWINGS

Preferred embodiments of the invention are described hereinafter with reference to the accompanying drawings herein:

FIG. 1 is a perspective view of a structure showing a foundation upon which sits a structure showing the exterior walls upon which shows the paths of Super High Tensile Tape or Ribbon Strips applied from one foundation wall over the roof structure to the opposite wall according continuity of opposite Continuous Load Paths, so as to help reinforce the overall structures's resistance to high winds, seismic, or other destructive events. The load paths' Super High Tensile Strength Tape is connected to the foundation via certain Attachment Mechanisms. These Attachment Mechanisms are affixed to the foundation by means of Tapcon© bolts applied to the upper foundation wall. FIG. 1 shows the connection of opposite load paths, thus resulting in a continuity of load paths and the overall unified load path concept.

FIG. 2 is a perspective view of a structure showing a foundation upon which sits a structure showing the exterior walls upon which shows the paths of Super High Tensile Tape or Ribbon Strips applied from one foundation wall with an intermediate connection to an attachment mechanism at the top of one wall. The Super High Tensile Strength Tape then proceeds over the roof structure to the opposite wall where it is connected to another attachment mechanism and then continues down the wall to the top of the opposite foundation where it is attached to the top of the foundation wall utilizing another attachment mechanism. This accords continuity of opposite Continuous Load Paths, so as to help reinforce the overall structures's resistance to high winds, seismic, or other destructive events. The load paths Super High Tensile Strength Tape is connected to the foundation via certain Attachment Mechanisms. These Attachment Mechanisms are affixed to the foundation by means of Tapcon© bolts applied to the upper foundation wall. FIG. 2 shows the connection of opposite load paths, thus resulting in a continuity of load paths and the overall unified load path concept.

FIG. 3 is a perspective view of a two story structure, showing a foundation upon which sits the two story structure with one exterior wall which show the paths of Super High Tensile Strength Tape or Ribbon Strips applied, either on the studs or on the sheathing, from one wall over the roof structure to the opposite wall down to the foundation. It also exhibits the location of the attachment mechanism on the top of the foundation. The figure demonstrates the installation of the Super High Tensile Strength Tape installed on each side of the structure's openings, i.e., windows and doors, to supplement and strengthen the structure's strength and resistance to uplift and lateral forces. It also demonstrates the connection of opposite load paths, thus resulting in a continuity of load paths and the overall unified load path concept.

FIG. 4 is a side view of an attachment mechanism which can be used to affix the SHTST to the structure at the top of its foundation. Said attachment mechanism would be affixed to the foundation using Tapcon© bolts. This is a view of the mechanism in the open state. Further information on this attachment is available in U.S. Pat. No. 8,943,761 B2.

FIG. 4*a* is side view of an attachment mechanism which can be used to affix the SHTST to the structure at the top of its wall sections. Said attachment mechanism would be affixed to structure at the top of its wall sections. It would be affixed to the structure using Hurriquake™ nails. This is a view of the mechanism in the open state.

FIG. 5 is a side view of the attachment mechanism set forth in FIG. 4, supra., wherein the mechanism has been closed and fully engaged and installed at the top of a foundation wall. Again further information is available in U.S. Pat. No. 8,943,761 B2 (see FIG. 4 of this Substitute Specification for patent).

FIG. 6 is a perspective view of an attachment mechanism which can be used to affix the SHTST to the structure either at the top of its foundation or at the top of its wall sections. Said attachment mechanism would be affixed to the foundation using Tapcon© bolts and it would be affixed to the structure using Hurriquake™ nails. Further information on this attachment is available in U.S. Pat. No. 8,943,761 B2 (see FIGS. 4, 4A & 5 of said patent).

FIG. 7 is a frontal view of an opening (window) in a structure. On each side of which is displayed Tape or Ribbon Strips of high strength threads being utilized to supplement the continuous load path around said opening. Further information on this application is available in U.S. Pat. No. 8,910,436 B2 (see FIG. 10 of said patent).

FIG. 8 shows a SHTST have a met layer or substrate and scrim layer comprised of Super High Tensile Strength Kevlar® (from DuPont's Kevlar® Advanced Performance Technology which delivers higher performance than Kevlar®'s 29) with the Kevlar® threads running longitudinally.

DETAILED DESCRIPTION OF THE INVENTION

Figure 5A:
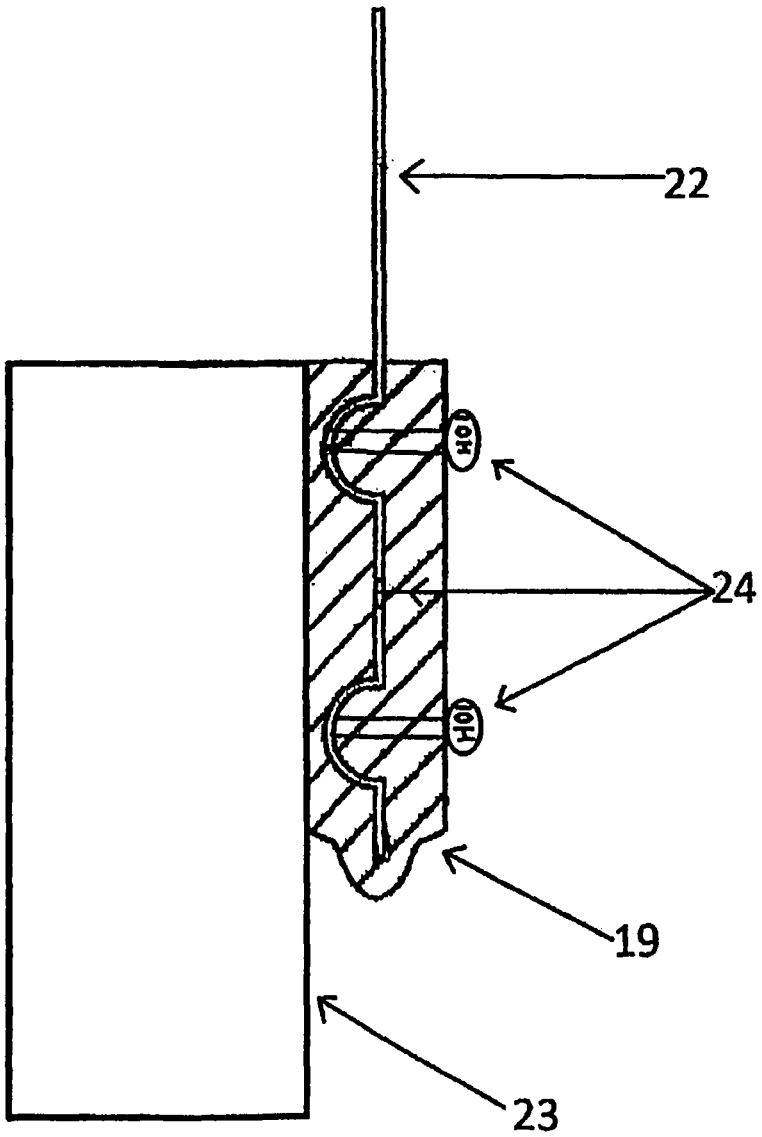
FIG. 5*a* is a side view of the attachment mechanism set forth in FIG. 4, supra., wherein the mechanism has been closed and fully engaged and installed on the structure at the top of wall. Again further information is available in U.S. Pat. No. 8,943,761 B2 (see FIG. 4 of this Substitute Specification for patent).

The Preferred embodiments shown in the drawings are an Apparatus for unifying and reinforcing a roofing structural system utilizing Super High Tensile Strength Tapes and/or Ribbon Strips, and Plastic Attachment Mechanisms. Said Apparatus is used to connect opposite Continuous Load Paths so as to result in a unified path extending from one foundation wall up its side wall and over the roofing system and then down the opposite wall to the top of the opposite foundation wall, so as to provide continuity of opposite load paths. This results in a unified and continuous load path of resistance to any uplifting, lateral forces, or any other destructive forces which might result from high wind, seismic or other destructive forces.

The apparatus for unifying and reinforcing a roofing structural system which utilizes Super High Tensile Strength Tape or Ribbon strips, and Plastic Attachment Mechanisms provides for connecting the Load Path of the means of supporting the roofing structure to the Load Path of the opposite means of supporting the roofing structure. This connection or continuity of Load Paths unifies the Load Paths and thus provides a better resistance to the uplifting, lateral and other forces created during a high wind, seismic or other destructive event. Metal clips, straps and connectors which are subject to rusting, corrosion, and the resultant loss of strength which yields a structure venerable to structural failure are eliminated by the use of the Super High Tensile Strength Scrims, Super High Tensile Strength Tapes and/or Ribbon Strips, and Plastic Attachment Mechanisms.

The use of said Super High Tensile Strength Tapes and/or Ribbon Strips, and Plastic Attachment Mechanisms to unify the Load Paths results in a structure which exhibits a high degree of Resiliency and Sustainability. The application of the uni-structure or uni-body concepts to continuous load path principals shall be applied to onsite structures, modular structures and factory build structures.

It is intended that the SHTST be made from higher strength lower elongation threads available from DuPont™'s Kevlar® line which are suitable for use to provide a Continuous Load Path and which can be used to resist upward and lateral forces without interfering with the natural downward forces exerted on a structure over time. The SHTST shall use DuPont™'s Kevlar® Advanced Performance Technology which delivers higher performance than Kevlar® AP29. It is also intended that the SHTST be from 2 inches in width to 12 inches in width to facilitate a spread of the load of the SHTST on the wall(s) and roof structure.

As shown in FIG. 1, which is a perspective view of a structure showing a foundation 1 upon which sits a structure 2 showing the exterior walls upon which shows the paths of Super High Tensile Strength Tape or Ribbon Strips applied from one foundation wall 3 over the structure, either on the studs or on the sheathing, over the roof structure 4 to the opposite wall 5 according continuity of opposite Continuous Load Paths so as to help reinforce the overall structure's resistance to high wind, seismic or other destructive events. The load path's Super High Tensile Strength Tape or Ribbon Strip is connected to the foundation 1 via certain attachment mechanisms 6 as shown in FIG. 3. FIG. 1 shows the location of the attachment mechanisms at the top of the foundation walls 1. These attachment mechanisms are affixed to the top of the outside wall of the foundation wall by means of Tapcon© bolts. This is a preferred embodiment of an Apparatus for unifying and reinforcing a roofing structural system utilizing a Super High Tensile Strength Tape or Ribbon Strip. It further shows In FIG. 1 the continuity and unifying of the opposite continuous load path 3A, & 5A to provide a unified load path 3, 3A, 4, 4A, 5 & 5A. This uni-structure load path shows the means for securing disposed vertically on the surface (either on the studs or sheathing) on the exterior wall section of the building, said means extending upward on the opposite wall structure to the top of its foundation where it is attached to the foundation via an attachment mechanism using Tapcon© bolts to affix said attachment mechanism to the top of its foundation wall.

As shown in FIG. 2, which is a perspective view of a structure showing a foundation 1 upon which sits a building structure 7, showing the exterior walls upon which displays the paths of Super High Tensile Strength Tape or Ribbon Strip applied from the top of one foundation wall 6 up to the top plates 8 (either on the studs or on the sheathing) wherein it attaches to an attachment mechanism at the top plates 8, or to a certain two sided attachment mechanism 8A at the top plates 8 and see FIG. 5, and then another Super High Tensile Strength Tape or Ribbon Strip continues over the roof structure 4 to the opposite wall 5, then attaching to another attachment mechanism or double sided attachment mechanism at 9A and see FIG. 5 for said attachment mechanism, according continuity of opposite Continuous Load Paths so as to help reinforce the overall structure's resistance to high wind, seismic or other destructive events. The load path's Super High Tensile Strength Tape or Ribbon Strip is connected to the foundation via certain attachment mechanisms. These attachment mechanisms are affixed to the top of the outside wall of the foundation wall by means of Tapcon© bolts. This is a preferred embodiment of an Apparatus for unifying and reinforcing a roofing structural system utilizing a Super High Tensile Strength Tape or Ribbon Strip. FIG. 2 further shows the continuity and unifying of the opposite continuous load path 8, 8A, 9 & 9A to provide a unified load path 8, 8A, 9, 9A & 10. This uni-structure load path shows the means for securing disposed vertically on the surface (either on the studs or sheathing) on the exterior wall section of the building, said means extending upward on the opposite wall structure to the top of its foundation where it is attached to the foundation via an attachment mechanism using Tapcon© bolts to affix said attachment mechanism to the top of its foundation wall.

Referring to FIG. 3, which is a perspective view of a structure showing a foundation 1 upon which sits a two story structure 18 also showing the exterior walls which show the paths of Super High Tensile Strength Tape or Ribbon Strips 12, 13, & 14, applied from one foundation wall 11 over the roof structure 15 to the top of the opposite foundation wall 16. Said Super High Tensile Strength Tape or Ribbon Strips shall be applied either on the wall studs or on the wall sheathing. This joining of load path accords continuity of opposite Continuous Load Paths so as to help reinforce the overall structure's resistance to high wind, seismic or other destructive events. FIG. 3 shows the location of the attachment mechanisms 17 affixing the Super High Tensile Strength Tape or Ribbon Strips to the foundation 1. Said Super High Tensile Strength Tape or Ribbon Strips are affixed on each side of the structure's openings 17A, both windows and doors, to increase the strength of the Continuous Load Path around the openings so as to provide increased strength to the structure.

The Load Path's Super High Tensile Strength Tape or Ribbon Strips are connected to the foundation 11 via certain attachment mechanisms shown in FIGS. 4, 4*a*, 5 and 5*a*. These attachment mechanisms are affixed to the foundation by means of Tapcon© bolts at the top of the exterior side of the foundation wall.

An additional benefit to the use of the attachment mechanisms as set forth herein and shown in FIGS. 4, 5 & 6 is that these mechanisms can re-tighten the SHTST to provide for any shrinkage which might occur in the wood or to re-tighten due to any other factors.

FIGS. 4, 4*a*, 5 and 5*a* are taken with permission from U.S. Pat. No. 8,943,761 B2 dated Feb. 3, 2015 and entitled "Building Construction Wrapped with Reinforcement Fabric to Resist Wind Loading" and from U.S. Pat. No. 8,646,222 B2 dated Feb. 11, 2014 and entitled "Building Construction Wrapped with Reinforcement Fabric to Resist Wind Loading," and are designated herein as FIG. 4, FIG. 4*a*, FIG. 5 and FIG. 5*a* respectively (different views of the same attachment in open state and closed state respectively). An irrevocable license has been granted to this inventor to use and practice all the inventions in the aforementioned U.S. Pat. Nos. 8,943,761 B2 and 8,646,222 B2. In the Provisional Patent which is cross referenced hereto, the attachment mechanism is referred to in FIG. 2 and is known as number 8 in said FIG. 2. It provides for the attachment of the Super High Tensile Strength Tape or Ribbon Strips to the structure. The Super High Tensile Strength Tape or Ribbon Strips is inserted into the mechanism and then bolted to the structure via the referred to Tapcon© bolts.

FIG. 4 is a side or cross-sectional view showing an attachment mechanism 19 hereafter referred to as the Clamshell Attachment Mechanism which is shown mounted on a foundation wall 20 via the use of a Tapcon bolt 21. This view of the Clamshell Attachment Mechanism is in the open state anticipating the installation of the SHTST. This FIG. 4 also show the SHTST 22 placed at the face of the Clamshell Attachment Mechanism 19 ready to be affixed.

FIG. 4*a* is a side or cross-sectional view showing the Clamshell Attachment Mechanism 19 which is mounted on the structure's wall 23 via the use of a Hurriquake Nail 24. This view of the Clamshell Attachment Mechanism 2A is in the open state anticipating the installation of the SHTST. This FIG. 4*a* also show the SHTST 22 placed at the face of the Clamshell attachment mechanism ready to be affixed.

FIG. 5 is a side or cross-sectional view showing the Clamshell Attachment Mechanism 19 which is shown mounted on a foundation wall 20 via the use of a Tapcon bolt 21. This view of the Clamshell Attachment Mechanism is in the closed state showing the SHTST 22 fixed into the Clamshell Attachment Mechanism and fully attached to the foundation wall.

FIG. 5*a* is a side or cross-sectional view showing the Clamshell Attachment Mechanism 19, which is shown mounted on the structure's wall 23 via the use of a Hurriquake Nail 24. This view of the Clamshell Attachment Mechanism 3A is in the closed state showing the SHTST 22 fixed into the Clamshell Attachment Mechanism 3A and fully attached to the structure.

FIG. 6 is taken with permission from U.S. Pat. No. 8,943,761 B2 dated Feb. 3, 2015 and entitled "Building Construction Wrapped with Reinforcement Fabric to Resist Wind Loading" and from U.S. Pat. No. 8,646,222 B2 dated Feb. 11, 2014 and entitled "Building Construction Wrapped with Reinforcement Fabric to Resist Wind Loading," and is designated herein as FIG. 6. An irrevocable license has been granted to this Inventor to use and practice herein all the inventions in the aforementioned U.S. Pat. Nos. 8,943,761 B2 and 8,646,222 B2. Additionally, an irrevocable license has been granted to this Inventor and to the benefit of this patent application, to use and practice all the inventions in U.S. Pat. Nos. 8,910,436 B2 and 8,646,222 B2. These license grants include all related prior patent applications and resulting patents thereof that the two herein mentioned Patents may be a continuation therefrom.

FIG. 6 is a perspective view of an attachment mechanism, the Wedge 25, which can be used to affix the SHTST 22 to the structure either at the top of its foundation with the use of Tapcon bolts 21, or at the top of its wall sections with the use of Hurriquake™ nails 24. In this patent application, the attachment mechanism known as the Wedge 25 provides for the attachment of the Super High Tensile Strength Tape or Ribbon Strips to the structure. The Super High Tensile Strength Tape or Ribbon Strip is inserted into the U-shaped portion of the attachment mechanism which has already been affixed to the structure by use of Hurriquake® Sheathing nails, and then once the Super High Tensile Strength Tape or Ribbon Strips is inserted into the slot of the mechanism then the Wedge male portion of the mechanism is pounded half way into the Wedge female (there should be tension on the SHTST), and then a thin line of Liquid Nails Polyurethane should be applied across the entire width of the Wedge male bracket so that the adhesive will seat with the SHTST into the slot and once fully inserted by pounding, the bracket is locked shut and further secured on the structure by use of additional Hurriquake® Sheathing nails firmly securing the wedge onto the structure and locking the female into the male slot.

FIG. 7 is a frontal view of a wall section showing an opening (window) 26 in a structure. On each side of the opening is displayed SHTST strips 22 being utilized to supplement the continuous load path around said opening. The SHTST strips 22 are affixed to the foundation with an attachment mechanism 17. The attachment mechanism used is either the Clamshell Attachment Mechanism 19, or the Wedge Attachment Mechanism 25.

FIG. 8 is a perspective view of a roll of the SHTST 22. It shows the a mat or substrate consisting of the tape portion of the SHTST upon which is affixed a scrim consisting of Super High Tensile Strength Kevlar® (from DuPont's Kevlar® Advanced Performance Technology which delivers higher performance than Kevlar®'s AP29) with the Kevlar® threads running longitudinally or in the machine direction.

The use of the SHTST 22 has additional applications to those set forth hereinabove. The SHTST 22 can also be used for automobile and vehicular applications, packaging, industrial uses, military uses, and any application where a super high tensile strength tape could be utilized to take advantage of its incredible strength and properties.

Without limiting the scope and application of this invention, the concepts herein can be used and applied to Platform, Balloon and Post-and-Beam construction. In addition, the concepts herein can be used in construction utilizing metal stud framing.

PREFERRED EMBODIMENTS

A preferred embodiment for the nails is the HurriQuake® Sheathing Nail which is manufactured by Stanley Bostitch of East Greenwich, R.I. A preferred embodiment for the adhesive is Liquid Nails® Polyurethane Construction Adhesive (low VOC) (LN-950) which is manufactured by AKZO NOBEL of 15885 West Sprague Road, Strongsville, Ohio 44136. Lastly, the preferred embodiment for bolts to anchor the attachment mechanism to the foundation is the Tapcon® bolt which is manufactured by ITW Red Head Division, 155 Harlem Avenue, Building N3E, Glenview, Illinois 60025.

This invention also relates to a kit comprising either a single assembly unit of the components of the structural fastening apparatus, or the individual piece of the components of the structural fastening apparatus, plus the SHTST to thereby provide a contractor or installer all the necessary parts to provide and afford continuity of opposite CLP's to secure the walls and roof of a frame structure to its foundation in one convenient collection. The structural fastening apparatus kit may also include all necessary fasteners and adhesives to attach and secure the individual pieces to their respective adjoining pieces or to the framing members of the structure as further described herein, without requiring separately obtained components. In another embodiment, the kit may be pre-assembled, wherein the SHTST is pre-cut to the required lengths and the first and/or second holding are pre-attached to the SHTST. The first and second holding members, the retaining member and the SHTST are then rolled up or folded into a convenient assembly for transport or shipping prior to installation.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of this patent application.

The invention resides not in any one of these features per se, but rather in the particular combination of all of them herein disclosed and it is distinguished from the prior art in this particular combination of all of its structures for the function specified.

There has thus been outlined, rather broadly, the more important features of the invention in order that the detailed description thereof may be better understood, and in order that the present contribution to the art may be better appreciated. Those skilled in the art will appreciate that the conception upon which this disclosure is based, may readily by utilized as a basis for the designing of other structures, methods, and systems for carrying out the several purposes of the present invention.

Further, the purpose of the foregoing description is to enable the U.S. Patent and Trademark Office and the public generally, and especially the scientist, engineers and practitioners in the art who are not familiar with the patent or legal terms of phraseology, to determine quickly from a cursory inspection the nature and essence of the technical disclosure of the application. The description is neither intended to define the invention of the application, nor is it intended to be limiting as to the scope of the invention in any way.

Any and all permutation or combinations of the of the listed embodiments herein are also asserted as embodiments. Each and every of said permutations and combinations is separately deemed to be an embodiment herein in its own right, and Engineering appropriate to the structure, the governing code, the local building community, and addressing potential high wind or seismic conditions will govern the use and deployment of said embodiment and establish separate embodiments herein each and everyone as its own embodiment.

These together with other objects of the invention, along with the various features of novelty characterize the invention. For a better understanding of the invention, its operating advantages and the specific objects attained by its uses, reference should be had to the accompanying drawings and descriptive matter in which there is illustrated preferred embodiments of the invention With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, fall in within the scope of the invention.

What is claimed is:

1. A structural reinforcement and fastening apparatus for a building frame structure having a foundation and roof comprising:

a super high tensile strength tape or ribbon strip consisting of:

aramid threads, wherein said threads form a column of threads oriented along a longitudinal axis of the tape or ribbon strip, said threads are from 2" to 12" in width having a minimum Nominal Breaking Strength of 150 Newtons/meter and extending to over 262 Newtons/meter as per ASTM's D7269;

said threads also have a minimum Nominal Tenacity of 225 cN/tex as per ASTM's D7269;

said threads have a Nominal Elongation At Break of 3.30% as per ASTM's D7269;

wherein said column of threads are laid upon and bonded to a substrate of plastic film or plastic ribbon which yields a non-woven tape or ribbon of super high tensile strength having a minimum Nominal Breaking Strength of 150 Newtons/meter and extending to over 262 Newtons/meter as per ASTM's D7269, wherein said tape or ribbon also has a minimum Nominal Tenacity of 225 cN/tex as per ASTM's D7269 with low elongation properties, said tape or ribbon having a Nominal Elongation at Break of 3.30% as per ASTM'S D7269 and hereafter referred to as Super High Tensile Strength Tape, hereafter known as SHTST, said SHTST having two end edge portions;

said foundation including a first foundation and a parallel foundation;

a first holding member attached along the first foundation;

a mounting bracket comprising an elongated flange that is configured and dimensioned to receive the first holding member, with the mounting bracket configured and dimensions for adjustable attachment to the building foundation to apply tension and hold the SHTST;

a second holding member attached along the parallel foundation;

a second mounting bracket comprising an elongated flange that is configured and dimensioned to receive the second holding member with the second mounting bracket configured and dimensions for adjustable attachment to the building foundation to apply tension and hold the SHTST;

wherein the SHTST has sufficient strength to provide continuity of the continuous load path from one foundation up a first wall over the roof and down a second wall to attach to the parallel foundation;

wherein said SHTST is configured in construction applications to provide a structure with hold down in high wind, seismic or other destructive events;

wherein said SHTST is configured to provide a continuous load path;

wherein said SHTST is configured to provide a unified, continuous load path from the first foundation of said structure over the roof decking and to the parallel foundation thus providing a Unistructure approach which is analogous to Unibody construction in the automobile industry;

and wherein said SHTST is configured for applications where a super high tensile strength low elongation resistant tape or ribbon is necessary or desirous to resist destructive forces.

* * * * *